US008061688B2

(12) United States Patent
Darbinyan

(10) Patent No.: US 8,061,688 B2
(45) Date of Patent: Nov. 22, 2011

(54) EXTENDABLE UTILITY BAR

(75) Inventor: Hrayr Darbinyan, Yerevan (AM)

(73) Assignee: JPJ Investment Holding Corp., Carson City, NV (US)

( * ) Notice: Subject to any disclaimer, the term of this patent is extended or adjusted under 35 U.S.C. 154(b) by 15 days.

(21) Appl. No.: 12/773,290

(22) Filed: May 4, 2010

(65) Prior Publication Data

US 2010/0283017 A1 Nov. 11, 2010

Related U.S. Application Data

(60) Provisional application No. 61/175,541, filed on May 5, 2009.

(51) Int. Cl.
*B66F 15/00* (2006.01)

(52) U.S. Cl. ..... 254/25; 254/129; 254/17; 254/18

(58) Field of Classification Search ..... 254/25, 254/18, 21, 26 R, 120, 121, 129
See application file for complete search history.

(56) References Cited

U.S. PATENT DOCUMENTS 584,189 A * 6/1897 Nelson ..... 254/19
1,467,914 A * 9/1923 Balcom ..... 29/249
6,948,700 B2 * 9/2005 Wood ..... 254/25
D591,134 S * 4/2009 Darbinyan ..... D8/89
D596,913 S * 7/2009 Anderson et al. ..... D8/89
7,618,031 B2 * 11/2009 Weaver et al. ..... 269/25
2010/0283017 A1 * 11/2010 Darbinyan ..... 254/129
* cited by examiner

*Primary Examiner* — Lee D Wilson
(74) *Attorney, Agent, or Firm* — Lackenbach Siegel LLP; Myron Greenspan

(57) ABSTRACT

An extendable utility bar includes a substantially straight elongate outer tube defining an axis and having inner and outer ends and an inner cylindrical surface. A substantially straight elongate inner tube has an axis generally coextensive with the axis of the outer tube and has inner and outer ends and an outer cylindrical surface configured and dimensioned to be slidingly engaged at the inner ends within the outer tube in telescoping relationship to move between fully retracted and extended conditions in which the remote ends of the tubes are minimum and maximum distances, respectively, from each other. A first prying member at the remote end of the outer tube and a second prying member at the remote end of the inner tube are provided. A lock selectively locks the inner and outer tubes relative to each other to fix the positions of the prying members at a distance no less than the minimum distance and no greater than the maximum distance. In this way, the length of the utility bar can be increased to provide increased prying leverage and can be decreased to shorten the length of the bar for storage or mobility.

20 Claims, 5 Drawing Sheets

EXTENDABLE UTILITY BAR

RELATED APPLICATIONS

This application claims the priority benefit of U.S. Provisional Application No. 61/175,541 filed on May 5, 2009, which provisional application is hereby incorporated by reference in its entirety.

BACKGROUND OF THE INVENTION

1. Field of the Invention

This invention generally relates to hand tools, and more particularly, to an extendable utility bar.

2. Description of the Prior Art

Numerous pry bars, sometimes also referred to as demolition tools or crow bars, are known that are multipurpose or multifunctional tools. However, most of these fail to provide such essential features for such bars, generally and for extendable bars specifically, like safety, ease of use, durability and convenience of use.

U.S. Pat. No. 6,948,700 discloses a telescoping demolition tool. The tool is designed for impact hammering, impact pulling and prying is provided with an elongate handle defining a passage extending therethrough and first and second rods inserted at respective ends of the handle. The first rod is slidably engaged within the handle and includes a hook at its outer end. The second rod is fixedly secured within the handle and includes a chisel at one end. The chisel can be used for impact chiseling or prying by sliding the first rod to a retracted position, such that its inner end collides with the inner end of the second rod. The hook may used for impact pulling by lifting the handle away from the hook into an expanded position in which the first rod is prevented from leaving the handle by a stopping mechanism. To increase leverage for prying, the tool may be extended to the expanded position. The stopping mechanism is within the handle so that the risk of injury to the user is reduced. However, the tool is not provided with any means for selecting and fixing the axial length of the tube in any one of a plurality of predetermined lengths that may be most appropriate or convenient for any specific application, job or project. The patent doesn't disclose a specific locking mechanism or details of locking (stopping) mechanism that will lock the two telescoping members relative to each other and provide safety and durability of the tool during heavy duty usage other than hammering or impact pulling. To the contrary, the very disclosure and intended function of the tool is to allow only relative axial movements of the two telescoping tubes.

Other patents that disclose multi-functional pry bars include U.S. Pat. Nos. 585,123; 5,938,177; 6,415,468; 6,913,246 and 6,986,504). However, these patents disclose pry bars that are either fixed in length or have complicated designs that are costly or inconvenient to use. Because some applications or projects require short utility bars due to space considerations and some require longer bars for added leverage where space considerations permit, manufacturers have frequently offered customers two or more utility bars that are sold together as a set in which the different bars of the set are each of a different fixed length so that the user can select one bar of the set having a desired length for a specific project or job. However, such multi-bar sets use more material, are more costly, heavier to carry and ship and occupy more storage space.

SUMMARY OF THE INVENTION

It is, accordingly, an object of the invention to provide an extendable utility bar that does not have the disadvantages known or inherent in existing utility bars.

It is another object of the invention to provide an extendable utility bar that is simple in construction and economical to manufacture.

It is still another object of the invention to provide an extendable utility bar that is convenient to use and which has a length that can be increased to provide increased prying leverage while it can be decreased to shorten the length of the bar for storage or mobility.

It is yet another object of the invention to provide an extendable utility bar as in the previous objects in which the length of the bar can be easily and quickly adjusted by means of a spring-loaded detent on one of the telescoping members and a series of spaced apertures on the other member for selectively receiving the detent, or an alternate locking mechanism that utilizes rotational movement of a pair of telescoping tubes about their axes relative to each other to selectively lock and unlock two telescoping members relative to each other to fix the overall length of the utility bar.

It is a further object of the invention to provide a utility bar that is formed of a pair of hollow telescoping tubes rendering the utility bar lighter in weight.

It is still a further object of the invention to provide an extendable utility bar as in the previous objects which can be made to collapse to a desired overall length of the utility bar and be extended to a desired length of the bar, typically within the proximate range of 16-22 inches.

It is yet a further object of the invention to provide an extendable utility bar that meets applicable ANSI standards by passing load test specifications.

It is an additional object of the invention to provide an adjustable utility bar of the type under discussion that can be used as a fixed-length hammer, nail puller, short bar and long bar.

It is still an additional object of the invention to provide an adjustable utility bar as in the previous objects that prevents early fatigue well known to users of heavy bars.

It is yet an additional object of the invention to provide an extendable utility bar as in the previous objects that, by virtue of its adjustable length, provides higher maneuverability and can be adjusted in length to provide maximum leverage in limited spaces where conventional bars provide little options for movement.

In order to achieve the above objects, as well as others which will become evident hereinafter, an extendable utility bar in accordance with the present invention comprises a substantially straight elongate outer tube defining an axis and having inner and outer ends and an inner surface. A substantially straight elongate inner tube has an axis generally coextensive with said axis of said outer tube and has inner and outer ends and an outer surface configured and dimensioned to be slidely engaged at said inner ends within said outer tube and in telescoping relationship to move between fully retracted and extended conditions in which said remote ends of said tubes are minimum and maximum distances apart, respectively, from each other. A first prying member is provided at said remote end of said outer tube, and a second prying member is provide at said remote end of said inner tube. Locking means is provided for selectively locking said inner and outer tubes relative to each other to fix the positions of said prying members at a distance no less than said minimum distance and no greater than said maximum distance. In this manner, the length of the utility bar can be increased to provide increased prying leverage and can be decreased to shorten the length of the bar for storage, mobility or increased maneuverability. The specific locking mechanism is not critical and may include a spring loaded detent that selectively enters one of a plurality of a series of axially spaced apertures or may include a friction clutch mechanism that locks the telescoping members when the are rotated in one direction relative to each other or unlocks the members when they are rotated in an opposite direction.

BRIEF DESCRIPTION OF THE DRAWINGS

The invention, together with the objects and advantages thereof, may best be understood by reference to the following description of the presently preferred embodiments together with the accompanying drawings in which.

DETAILED DESCRIPTION OF THE PREFERRED EMBODIMENT

Figure 1:
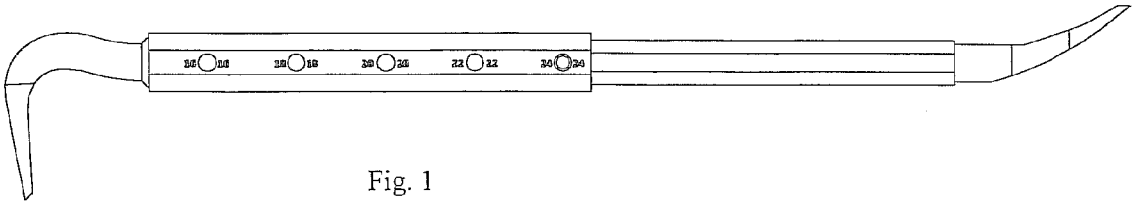
FIG. 1 is a side elevational view of a pry or utility bar in accordance with a presently preferred embodiment, shown in a fully extended position.

Referring now specifically to the figures, in which identical or similar parts are designated by the same reference numerals throughout, and first referring to FIG. 1, an extendable utility bar in accordance with the present invention is generally identified by the reference numeral 1.

Figure 2:
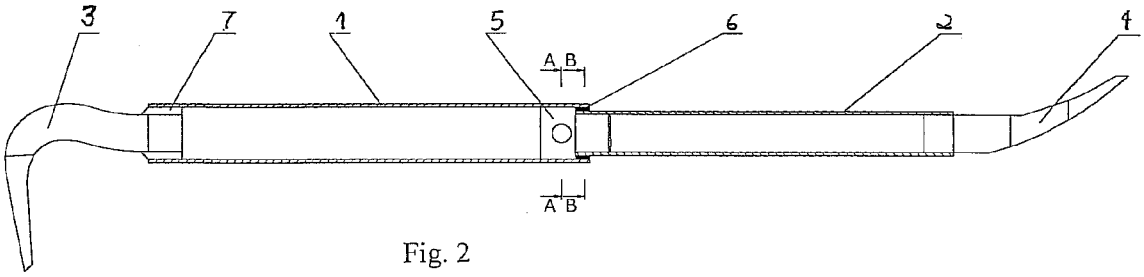
FIG. 2 is a longitudinal cross-section of the bar in FIG. 1 through an axial plane illustrating the one hollow tubular member in telescoping relationship with a second telescoping member that may be hollow or solid.
Figure 3:
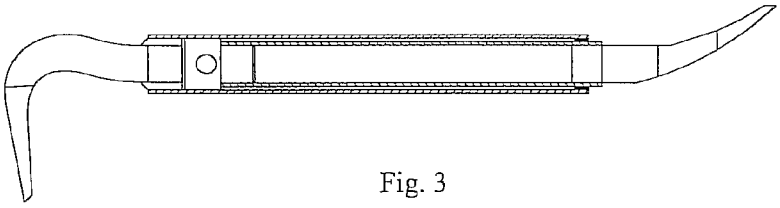
FIG. 3 is similar to FIG. 2 but showing the bar in a contracted or collapsed condition.
Figure 4:
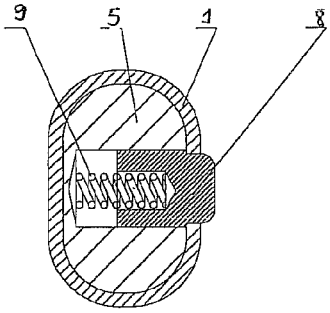
FIG. 4 is a cross-sectional view of the bar shown in FIG. 2, taken along line A-A.
Figure 5:
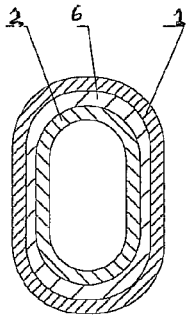
FIG. 5 is similar to FIG. 4 but taken along line B-B in FIG. 2.

The bar consists of large pipe 1 (FIG. 2), small pipe 2, hook tip 3, shovel tip 4, slider 5, inserts 6 (FIG. 5), adaptor 7, button 8 and spring 9 (FIG. 4). The hook tip 3 is welded to the large pipe 1 through an adaptor 7, the shovel tip 4 is welded to the small pipe 2 directly. On the other end the small pipe bears a slider 5, having a blind hole with a spring 9 and button 8 inside. The button is ended by a shoulder of small diameter that comes out from one of the holes of the large pipe. The large pipe has numerous holes for fixing different lengths of the bar. Two inserts 6 are inserted into the hole of the large pipe and are welded to the large pipe. Thus disassembling of the bar becomes impossible. Both large and small pipes have oval cross section, that keeps the tips to be in definite position not depending the length of the bar, provides easy length adjustment procedure, so far the button moves along a single line crossing all the available holes in the large pipe, and finally provides comfortable handling of the tool.

The bar is to be used in the following way. The user holds the large pipe in one hand and the small pipe in the other, being able to press down the button for adjustment. Once the button is pressed down, to pieces gain ability to move relatively and the user pulls out or pushes back the pipes adjusting the necessary length. One option of having different lengths provides 16", 18", 20", 22" and 24" length for the bar. Once the necessary length is reached the button jumps out in the hole of the large pipe and the length of the bar is fixed. The user is able to control the length of the bar thorough recognition marking on one of the flats of large pipe (FIG. 1). The longer bar can be used for wrecking and nail pull out functions, while the shorter lengths are suitable for striking, picking or fixed-length hammering.

The second embodiment includes tubular bodies moving one inside each other and being locked relatively by means of a lock mechanism. For this purpose the bar consists of the large pipe small pipe, lock mechanism and guidance bushing. The user unlocks the two pipes by means of the lock mechanism and adjusts the length of the bar by moving one into another. Then the user locks it back at the required length. The large and small pipes have tips entering each pipe by its distal end and welded to the pipe. The tips of wrecking bar are shown as the shovel shaped tip and the hook shaped tip.

When applying a regular lock mechanism as mentioned above the orientation of the shovel tip and the hooked tip is not definite that is when rotating the bar they may have random position, which is the main problem of regular eccentric lock mechanism.

For resolving this issue a special lock mechanism is applied that prevents random orientation of the tips and provides the tips to be in the same plane regardless the length of the tip and the user's skill.

Figure 7:
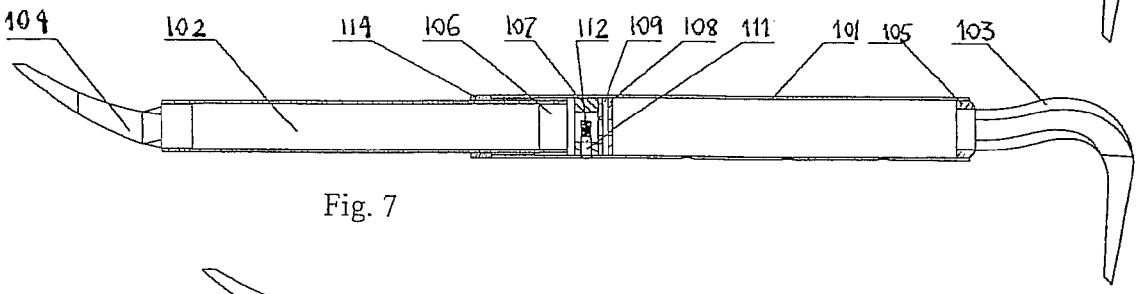
FIG. 7 is similar to FIG. 2 for the embodiment shown in FIG. 6.
Figure 8:
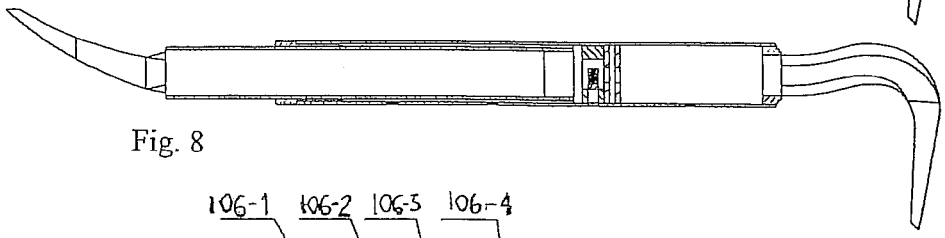
FIG. 8 is similar to FIG. 3 for the embodiment shown in FIG. 6.
Figure 9:
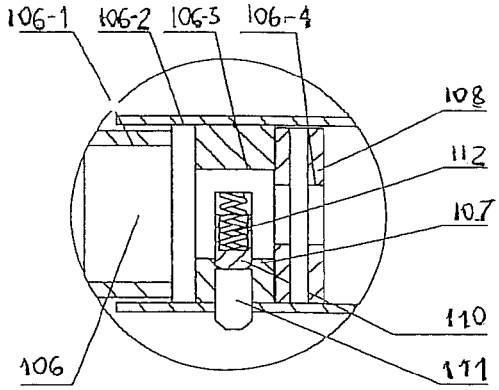
FIG. 9 is a longitudinal cross-sectional detail of the bar shown in FIG. 6 illustrating the components that form the detent locking mechanism for selectively locking the telescoping members in one of a plurality of relative longitudinal or axial positions.
Figure 10:
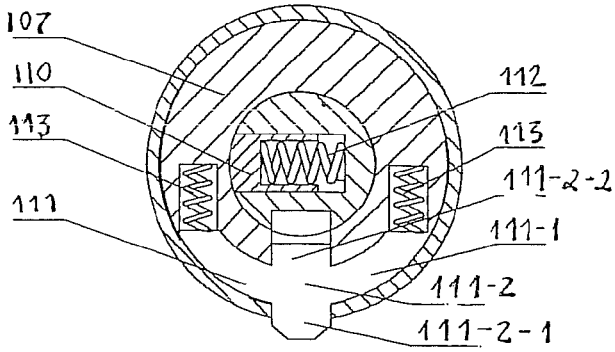
FIG. 10 is a transverse cross-section through the locking mechanism shown in FIG. 9 showing the locking components in a locked condition.

The bar consists of the telescopic pipes welded to the tips and the locking mechanism for fixing pipes after length adjustment. The extendable bar and its lock mechanism consist of large pipe 101 small pipe 102, hook tip 103, shovel tip 104, bushing 105, eccentric shaft 106, eccentric 107, eccentric ring 108, pin 109, bomb 110, bird 111, bomb spring 112, bird spring 113 and plastic bushing 114 (FIGS. 7, 9, 10).

The large pipe 101 (FIG. 6) is welded to the hook tip 103 with a bushing 105 between them and the small pipe 101 is welded to the shovel tip 4 directly. The other end of small pipe 102 is welded concentrically to eccentric shaft 106, which has four shoulders (FIG. 7, 9), first (106-1) for going inside the small pipe for being welded to it, second (106-2) for contacting the inner surface of the large pipe and concentric to first shoulder (106-1), third (106-3) for bearing the eccentric 107, this shoulder (106-3) is shifted relative the first two shoulders on the value of eccentric. And fourth (106-4), smallest shoulder concentric to shoulder (106-3) and eccentric to shoulders (106-1) and (106-2).

Eccentric shaft 106 (FIG. 9) has two blind holes arranged at 90 degree relative each other and drilled in the second shoulder (106-2). First hole is for putting a bomb 110 inside, which is a cylindrical body with concentric blind hole for spring. And second hole is a low depth blind hole for another part of lock mechanism called bird 111 for its shape. Forth shoulder (106-4) of the eccentric shaft carries an eccentric ring 108 having outside diameter equal to the diameter of shoulder two of the eccentric shaft 106 and has an eccentric hole for assembling with the fourth shoulder of eccentric shaft. After assembling the eccentric ring 108 on eccentric shaft 106, the outside cylindrical surface of eccentric ring and the cylindrical surface of shoulder two of the eccentric shaft are concentric and have the same diameter. Eccentric ring 108 is assembled on the eccentric shaft 106 by means of pin 109.

Figure 6:
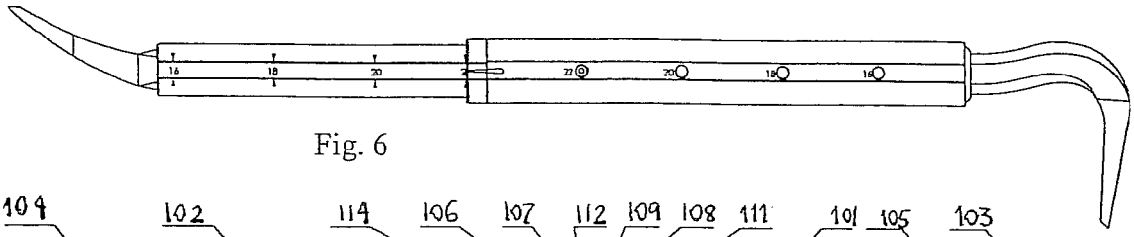
FIG. 6 is similar to FIG. 1 but showing an alternate embodiment of the extendable utility bar in which the telescoping member have generally circular cross-sections instead of oval or elliptical cross-sections of the embodiment shown in FIGS. 1-5.

The part called eccentric 107 has a hole which is eccentric relative outer cylindrical surface and has diameter to fit the shoulder three of the eccentric shaft. Shaped and assembled in this way the three outer cylindrical surfaces of the eccentric shaft 106 (shoulder three), eccentric 107, and eccentric ring 108 are the same and identical. The described position of the three mentioned parts provides unlocked condition, when two pipes can be relatively freely moved (FIG. 9, 11). A part called bird 111 (FIG. 10, 11) is composed of wings 111-1 and body 111-2, the body itself has two operational portions, a big chamfered head 111-2-1 and small chamfered tail 111-2-2, the wings 111-1 are symmetrical relative the body and are for loading the total part by two compression springs-bird spring 113. The bird 111 is located in special shape groove done in the body of the eccentric 107. The groove has a radial through hole for the body of bird and two blind holes for the springs 113, the three holes are connected by a narrow channel, slightly wider than the thickness of the wing. Thus the wings are rested on compression springs 113 and the body of bird is located in the through hole of eccentric 107. The eccentric shaft 106 is equipped by a bomb 110, located in a blind hole and also loaded by compression spring-bomb spring 112. And finally the large 101 pipe is equipped with a number of holes located along a line parallel to its axis (FIG. 6).

The bar is assembled in following way. After having the tips welded to the pipes, the plastic bushing 114 is assembled on the small pipe and then the eccentric shaft is welded to the small pipe. Then the bomb with its spring is located in the eccentric shaft and the eccentric is assembled on the eccentric shaft. Next eccentric ring is assembled and pinned to the eccentric shaft. Then the bird is assembled into the eccentric with its springs and the whole small pipe assembly is moved inside the large pipe, after which the plastic bushing is glued to the large pipe. The lock mechanism works in the following way.

The initial situation (FIG. 11) is considered the unlocked position of two pipes, small pipe and large pipe, when they can be easily moved relative each other and also be rotated. This is an unforced movement requiring a low force, that s just greater than the force of friction between the movable parts.

Figure 11:
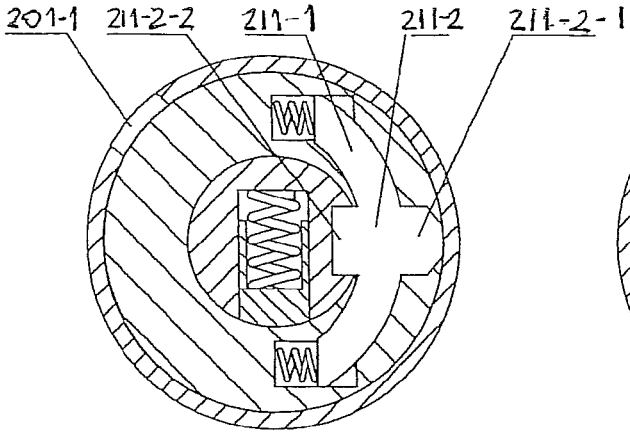
FIG. 11 is similar to FIG. 10 but showing the detent or bird removed from the aperture in the outer tube to allow free relative sliding movements.
Figure 12:
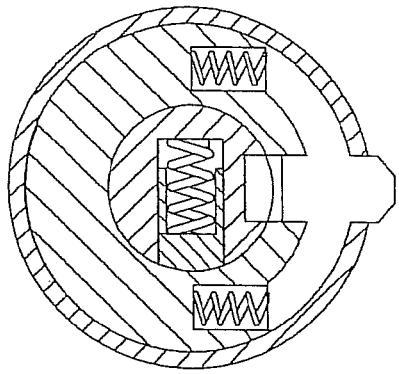
FIG. 12 is similar to FIG. 11 but showing the detent within the aperture for locking the telescoping members relative to each other.

This free movement is ended when the user wants to achieve definite length of the bar, for this purpose the user moves the small bar inside the large bar and finds a definite hole in the large pipe by the head of bird (FIG. 12). Initially the tail of the bird (111-2-2) is pressed into the recess (low depth blind hole) in the eccentric and its head is contacting the inner cylindrical surface of the large pipe. Accordingly the bomb is pressed in the eccentric shaft and its head is contacting the inner cylindrical surface of the eccentric. In such condition the two parts, eccentric shaft (same with the small pipe) and the eccentric with pressed in bird and bomb are acting as one part that can be moved freely inside the large pipe (FIG. 11).

This free movement is ended when the head of the bird finds one of predefined holes in the large pipe. After that the bird jumps out to the hole of the large pipe and stops axial movement of the small pipe. The axial position of the two pipes is achieved now (FIG. 12). For the same time the tail of the bird moves away from the recess of the eccentric shaft and allows rotational movement of the eccentric shaft (small pipe). Also it creates a space under its tail and third shoulder of the eccentric shaft to be later used and filled by the head of bomb (FIG. 12).

Figure 13:
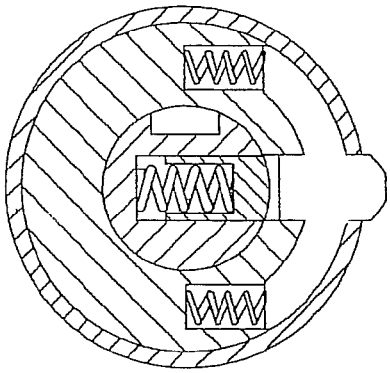
FIGS. 13 and 14 are similar to FIG. 12 with the shaft rotated for locking the members relative to each other.
Figure 14:
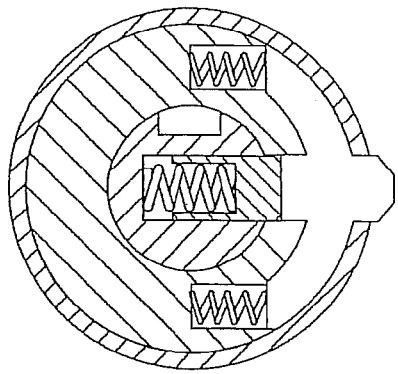

To implement the locking function the user rotates the small pipe relative large pipe counter clockwise for 90 degrees (FIG. 13). As a result the head of the bomb enters the above mentioned space and a locked condition is achieved (FIG. 14).

The last movement is a forced movement (rotation) so far eccentric and concentric surfaces are contacting, and this movement becomes possible when having definite gap between the inner cylindrical surface of the large pipe and general outer cylindrical surface of three above mentioned parts—shoulder two of eccentric shaft, eccentric and eccentric ring. The gap is evaluated to be from 50% to 80% of the eccentric value. That is when the eccentric is 0.5 mm the gap can be between 0.25 mm to 0.4 mm depending on the quality of surface and the material of contacting surfaces. As a result of this forced movement a looseness connection between the lock mechanism parts is achieved (FIG. 14).

The axis of the hole for bomb in the eccentric shaft (which is one piece with small pipe) and the axis of the small pipe generate a plane which has quite definite arrangement (position) relative the shovel tip of the bar. So the contact of the bomb in eccentric, which includes the bird, and the bird contacts the hole in large pipe means now a radial definition of both tips. Both pipes are locked and no relative movement is possible now. (FIG. 14). Also should be noted that the locked position has no looseness, because the gap necessary for the eccentric shaft movement was covered by eccentric and some extra pressure was used to bring the head of the bomb to the space in the eccentric.

Figure 15:
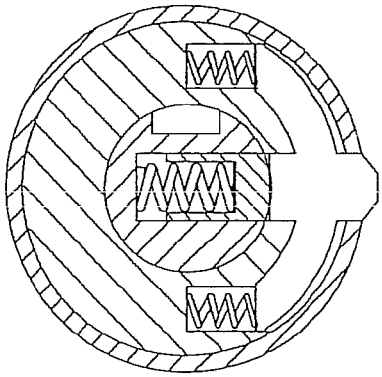
FIG. 15 is similar to FIG. 14 showing the detent depressed prior to unlocking of the telescoping members.

For implementing the unlock function the user press the head of the bird to a limited stop, which is the bomb, being moved in the blind hole of the shaft accordingly (FIG. 15) This movement is stopped when the bomb reaches the bottom of the blind hole and its heads approaches the cylindrical surface of shoulder three of the eccentric shaft. Meanwhile the head of the bird is inside the position hole of the large pipe, so the eccentric is connected to the large pipe and the eccentric shaft is ready to rotate back and unlock the connection shaft-eccentric-large pipe.

Figure 16:
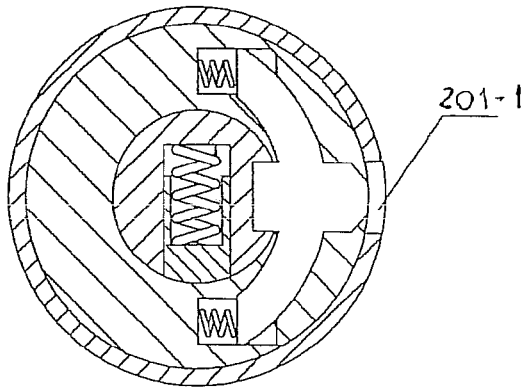
FIG. 16 is similar to FIG. 15 in which the detent is fully depressed beyond the aperture and the shaft rotated to allow free relative axial movements of the two telescoping members.

After 90 degree back rotation of the small pipe the connection is unlocked and the blind hole of the eccentric shaft comes under the tail of the bird, further pressing on the head of bird moves it down to the blind hole and the head of the bird comes close to large pipe inner cylindrical surface (FIG. 16). Further rotation of the small pipe clock wise takes the head of the bird away from the hole and position as described for FIG. 6 is recovered, which is totally unlocked condition, when the pipes can be moved freely relative each other (FIG. 16).

How the User Adjusts the Bar Length?

The user takes the bar which is locked in two hands, presses the head of the bird that comes out from one of the large pipe holes and rotates the one pipe relative the other for 90 degree. Meanwhile he holds the bird in pressed position. After the 90 degree rotation the bird goes more inside and totally is lost in the large pipe. The user rotates more than 90 degree and gets a condition when the pipes are freely moved relative each other. Then he finds another hole corresponding to next length and rotates the pipes back, after 90 degree forced rotation the bar is locked again at a new length.

The invention relates to bars, more specifically to extendable bars having telescopic structure of pipes allowing to adjust the length of the bar for different purposes.

The known bars have definite length that adds weight and size to the product causing problems in usage for different applications also for storage and handling.

The present invention aims to make the bar adjustable in length by this to save weight and to have the chance for the length adjustment. And second aim is to provide a special lock mechanism that will allow fixing the bar at any length.

This achieve the first goal the bars are made as tubular bodies moving one inside each other and being locked relatively by means of a lock mechanism. For this purpose the bar consists of the large pipe small pipe, lock mechanism and guidance bushing. The user unlocks the two pipes by a relative rotation and adjusts the length of the bar by moving one into another. Then the user rotates bars back at the required length. The large and small pipes have tips entering each pipe by its distal end and welded to the pipe. The tips of wrecking bar are shown as the shovel shaped tip and the hook shaped tip.

The bar consists of the telescopic pipes welded to the tips and the locking mechanism for fixing pipes after length adjustment. The extendable bar and its lock mechanism consist of large pipe 101, small pipe 102, hook tip 103, shovel tip 104, bushing 105, eccentric shaft 106, eccentric 107, screw 108, plastic bushing 109 and rubber stop 110 (FIGS. 7, 9, 10).

The large pipe 101 (FIG. 7) is welded to the hook tip 103 with a bushing 105 between them and the small pipe 101 is welded to the shovel tip 104 directly. Plastic bushing 109 is glued or connected to the large pipe to prevent come out of the small pipe.

Lock mechanism consist of two parts: an eccentric shaft 6 and plastic eccentric 107. Eccentric shaft 106 is screwed to the small pipe 102 by means of the screw 108 and plastic eccentric 107 is assembled on the eccentric shoulder of the eccentric shaft 106 by stretching its wings out and putting on the eccentric shoulder.

Lock mechanism works in the following way. At initial position not locked (FIG. 9, 10) the outer surface of the eccentric 107 is inside the large pipe 101 and the small pipe 102 with the eccentric shaft 106 and the eccentric 107 can be moved freely inside the large pipe 101.

For implementing the locking function the user adjusts the length of the bar and relatively rotates the pipes. When doing this the outer diameter of the eccentric 106 (FIG. 11, 12) touches the inner surface of the large pipe and due to friction forces stops to be rotated relative the large pipe. Further relative rotation of the pipes results in moving the eccentric shaft eccentric shoulder to the thick portion of the eccentric 107 and pressing it against the inner surface of the large pipe. Thus the lock is achieved. Unlocking procedure is to rotate back the pipes.

A rubber stop 110 is provided inside the large pipe to prevent sound hitting of the pipes when they reach ultimate short position.

The third embodiment of the utility bar or the extendable utility bar includes an outer tube or pipe 201 and an inner tube or pipe 202. The outer tube is a substantially straight elongate outer tube or pipe that defines an axis A has an inner end 14*a* and an outer end 14*b*. Similarly, the inner tube 202 is a substantially straight elongate inner tube or pipe having an axis A generally coextensive with the axis of the outer tube, both being aligned on axis A in FIG. 17 and having an inner end 14*a* and an outer end 14*b*.

Figure 17:
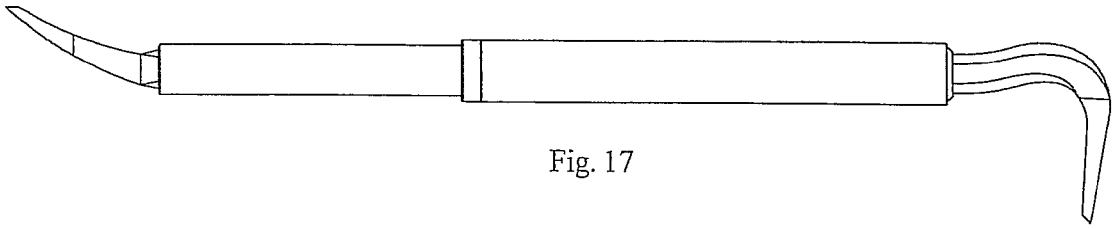
FIG. 17 is a side elevational view of still another embodiment of a utility bar in accordance with the present invention, shown in its fully extended condition.
Figure 18:
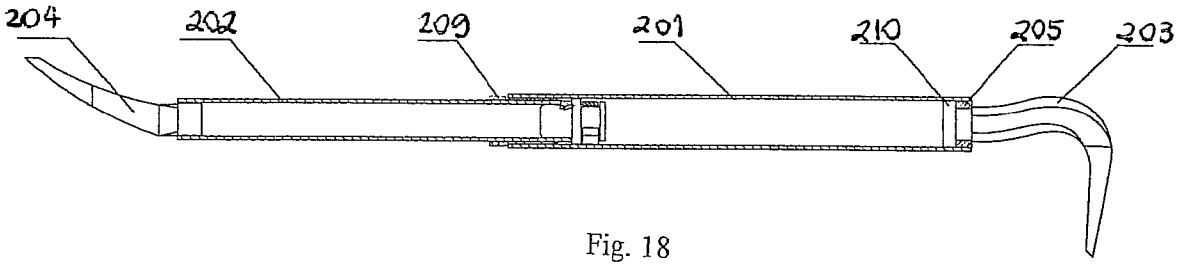
FIG. 18 is a longitudinal section taken along a plane extending through an axis of the telescoping tubes forming the extendable utility bar.
Figure 19:
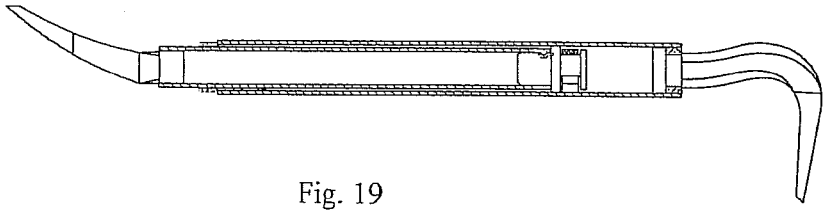
FIG. 19 is similar to FIG. 18 but showing the telescoping tubes in their fully retracted or collapsed condition.
Figure 20:
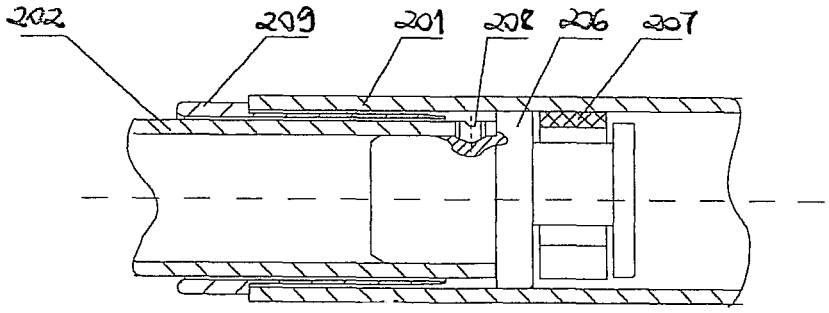
FIG. 20 is an enlarged cross-sectional view of the inner ends of the two telescoping tubes of the bar of FIG. 17, showing the details of the locking mechanism used to selectively release or lock the telescoping tubes to allow or prevent axial movements thereof relative to each other.

Referring also to FIG. 20, the outer tube 201 has an inner cylindrical surface 12*c* while the inner tube has an outer cylindrical surface 14*c* configured and dimensioned to be slidingly engaged at the inner ends 12*a*, 14*a* within the outer tube in telescoping relationship to move between a fully retracted condition shown in FIG. 19 and a fully extended condition shown in FIGS. 17 and 18 in which the remote ends 12*b*, 14*b* of the tubes are at a minimum and maximum distances apart, respectively, from each other.

A first prying member, in the form of a generally L-shaped hook 203 is provided at the remote end 12*b* of the outer tube. A second prying member, in the form of a substantially straight but slightly curved chiseled tip, is provided at the remote end 14*b* of the inner tube 202. While in the embodiment shown the prying members are arranged as shown and described, it should be clear that the hook shaped prying member and chiseled shape prying member can be reversed on the tubes, and the tubes may even be provided with the same prying members if so desired. The specific arrangement of prying members or there specific configurations are not critical for purposes of the present invention.

In accordance with the broad aspects of this invention, suitable locking means is provided for selectively locking the inner and outer tubes 201, 202 relative to each other to fix the positions of the prying members 203, 204 at a distance no less than the minimum distance when the telescoping tubes are fully collapsed or retracted one into the other, and no greater than a maximum distance with a telescoping tubes are extended. As will be evident from FIGS. 17-19, therefore, the length of the utility bar can be increased to provide increased prying leverage and can be decreased to shorten the length of the bar for storage or mobility or increased maneuverability in tight spaces.

Referring to FIGS. 18-20 and 22, the inside diameter of the inner cylindrical surface 12*c* is slightly larger than the outer diameter of the outer cylindrical surface 14*c* to produce a annular space or gap between these two surfaces. A bushing

209, preferably made of plastic, is permanently attached to the inner end 12*a* of the outer tube 201 to fill the annular gap or space with some clearance to permit free sliding movement of the inner and outer tubes 201, 202 relative to each other while maintaining the tubes generally aligned in coaxial relationship along the axis A. The plastic bushing 209 serves as friction reducing element for reducing the friction between the inner and outer tubes when the tubes are moved in telescoping relationship to each other. The specific plastic material from which the bushing 209 is made is not critical as long as it is a low friction material such as Nylon.

Secured in any conventional way a first prying member 203 in the form of a substantially L-shaped hook is permanently attached to the free end 12*b* of the outer tube 201. Referring to FIG. 18, a bushing 205 may be provided between the hook 203 and the inner diameter of the outer tube 201. An optional rubber stop 210 may be provided approximate to the bushing 205 to serve as a buffer for the free end of the inner tube 202 when the ladder is moved into the outer tube 201 to its fully contracted position shown in FIG. 19. The rubber stop 210 avoids the sound and feeling of metal hitting metal and provides the tool with a more user friendly feel. Similarly, another prying member 204 is permanently attached to the outer end 14*b* of the inner tube 202. Shown in the embodiment is a chisel-shaped prying member which is slightly curved to correspond with tips or ends that are commonly used on utility bars. However, it will be clear that any shaped tips or prying tools may be attached to the outer ends of the tubes as may be needed or desired for any given application.

Figure 22:
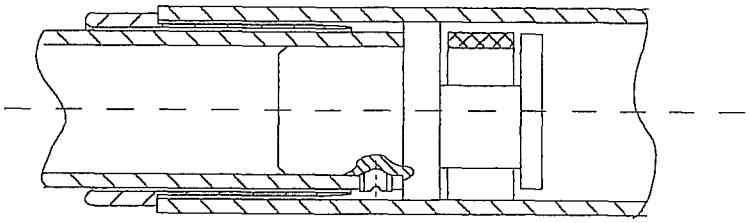
FIG. 22 is similar to FIG. 20, but showing the eccentric locking mechanism in its locked condition to prevent relative axial movements of the telescoping tubes relative to each other.

Referring primarily to FIGS. 20 and 22, stop means is provided for limiting the relative movements of the tubes beyond the maximum distance achieved when the tubes are fully extended to prevent separation of the tubes. This is achieved, in the embodiment shown, by providing an inner end of the inner tube with a member 207 which has at least an enlarged portion as shown in the close proximity to the inner cylindrical surface 12*c*. A suitable blocking member is provided at the inner end of the outer tube to provide an interference fit when the blocking member contacts the enlarged portion 208 at the fully extended condition. In the embodiment described, the blocking member is again performed by the plastic bushing 209 which projects a radially inwardly so that when the enlarged centering portion or disk 207 abuts against the inner end of the plastic bushing 209 the bushing stops the disk 207 and can no longer move outwardly.

A feature of the extendable utility bar in accordance with the invention is the provision of the locking mechanism for selectively locking the two telescoping tubes or pipes relative to each other at any desired positions within the minimum and maximum length perimeters. While any locking mechanism may be used for this purpose that will perform the functions, an eccentric mechanism 206 is provided which is responsive to rotations of the tubes 201, 202 relative to each other about the axis A.

The eccentric mechanism 206 is attached and secured to the inner end 14*a* of the inner tube 202 so that the eccentric mechanism 206 shares the angular rotations of the inner tube 202 about the axis A relative to the outer tube 202. Specifically, there is provided an attachment portion 22*a* which is in the form of a stub coaxially arranged within the inner tube 202 suitably attached to the inner tube by any suitable or conventional way. Thus, the attachment portion 22*a* may be press fit within the inner tube, or it may be attached by suitable adhesive, welded to the inner tube or, as shown in the illustrated embodiment, by means of a set screw (not shown) received within a threaded bore mounted for advancement radially inwardly towards the axis A to come into contact with the outer cylindrical surface of the attachment portion 22*a*. Preferably to enhance the strength of the connection, there is advantageously provided a depression or recess 6*b* in the outer surface of the attachment portion 22*a* that can be aligned to register with the threaded bore so that when the set screw is advanced radially inwardly it can be received within the depression 6*b*. This ensures that the attachment portion 22*a* remains securely attached to the small pipe or inner tube 202 even with repeated use of the item. Integrally formed with the attachment portion 22*a* is the centering portion or disk 22*c* which, as indicated above, also serves as the stop member when it engages the plastic bushing 209. Extending radially outwardly, in the direction of the outer end 12*b* of the outer tube 201 is an eccentric shaft portion 207 which, as shown, is offset in relation to the axis A so that a rotation of the inner tube 202 causes the eccentric shaft portion 207 to move radially towards or away from the axis A.

The eccentric mechanism 206 also includes an eccentric ring 208 concentric with the eccentric shaft portion 207 and dimensioned to be pressed against the inner cylindrical surface 12*c* in a locking condition of the eccentric mechanism to prevent axial movements of the tubes 201, 202 relative to each other, or to create a clearance with the eccentric shaft portion to relieve any frictional forces and to allow free axial movements of the tubes 201, 202 relative to each other in non-locking conditions of the tubes.

Figure 21:
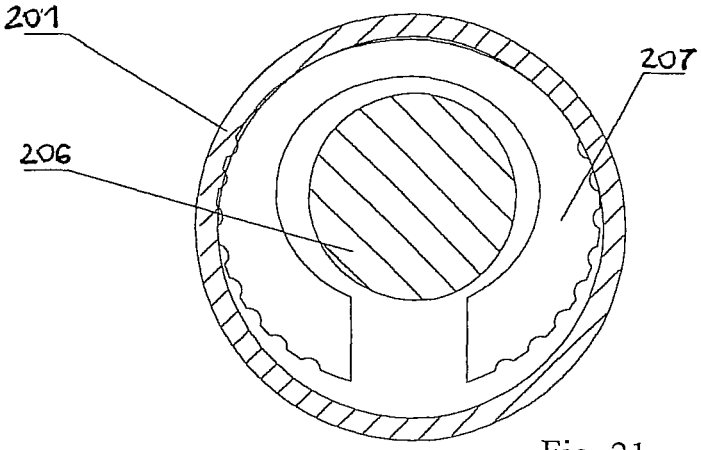
FIG. 21 is an enlarged cross-sectional view of the eccentric mechanism, taken along line 5-5 in FIG. 20, showing the eccentric mechanism in its unlocked condition to allow relative axial movements of the telescoping tubes relative to each other.
Figure 23:
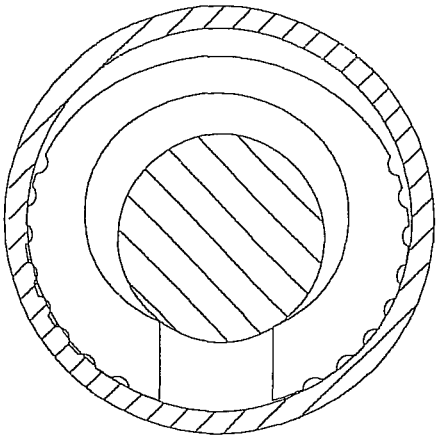
FIG. 23 is similar to FIG. 21, taken along line 7-7 in FIG. 6, showing the eccentric locking mechanism in its locked position for preventing relative axial movements of the telescoping tubes relative to each other.

As best shown in FIGS. 21 and 23, the eccentric ring 208 has two diametrically opposite portions 24*c*, 24*d* of minimum and maximum radially dimensions, respectively. The eccentric ring 208 is preferably provided with a circumferential gap 24*e* in the portion 24*d* of maximum radial dimension to allow the eccentric ring 208 to radially expand when the eccentric shaft portion 207 contacts the ring 208 at the gap 24*e* as shown in FIG. 23.

As illustrated, at least a portion of an outer perimeter of the eccentric ring 208 is provided with alternating recesses and ridges 24*a*, 24*b*. By making the eccentric ring 208 from a material that can create frictional forces when urged against the inner cylindrical surface 12*c*, the recesses and ridges can become deformed when sufficient pressures are applied to the ring to increase the frictional forces with the inner cylindrical surface 12*c*.

The eccentric mechanism 206 also includes a generally transverse retaining disk 207 arranged normal to the axis A and dimensioned to capture the eccentric ring 208 in maintaining it concentric with the eccentric shaft portion 207 in all relative axial positions of the tubes 201, 202.

The described eccentric mechanism 206 is illustrative of a presently preferred arrangement. However, it will be clear that other similar or alike mechanisms may be used for selectively locking two telescoping hollow shafts or tubes relative to each other to prevent further rather axial movements, with such locking motion being achieved by relative angular rotation of the tubes relative to each other about the axis A. The eccentric ring 208 may also be formed of a plastic material that provides structural integrity and resistance to permanent deformation, especially with repeated uses, while providing adequate friction, when pressed against the inner cylindrical surface 12*c* to prevent relative axial movements of the tubes.

In operation, with the utility bar not in a locked position, as shown in FIGS. 20 and 21, the outer surface of the eccentric ring 208 is positioned within the outer tube 201, while the inner tube 202 with the eccentric shaft portion 207 being freely movable inside the outer tube. To implement the locking function, the user adjusts the length of the bar by sliding the tubes 201, 202 relative to each other in telescoping action and, when the desired overall length of the tool has been reached rotates the tubes 201, 202 relative to each other about the axis A. When this occurs, the outer surface with the recesses 24*a* and ridges 24*b* contact the inner cylindrical surface 12*c* of the outer pipe 201 and applies frictional forces to prevent further rotation relative to the outer pipe. Further relative rotation of the pipes results in moving the eccentric shaft portion 22 to the thicker or wider portions 24*d* of the eccentric ring 208, pressing it against the inner cylindrical surface 12*c* of the outer pipe 201. Locking is, therefore, achieved. Unlocking the pipes entails a reverse sequence of the described steps.

The rubber stop is preferably provided inside the outer tube to prevent the generation of potentially loud sounds of the pipes hitting each other when they reach the ultimate short position.

It will be evident from the above discussion that an extendable utility bar in accordance with the present invention results in a bar that is lighter in weight, lower in cost and one that may serve multiple purposes. A length adjustment of the bar is simple and convenient, and the use of light tubular shanks or pipes renders the overall tool lighter in weight and this produces less fatigue with extended use. Traditional tips of conventional wrecking bars may be used so that all of the same functions and uses can be achieved with the extendable bar as with traditional fixed length bars.

Because of the adjustability of the overall length the utility bar, it is more user friendly and increases maneuverability, unlike conventional bars that usually have one or two functions. The subject bar allows its use in a wider field of applications and is easy for storage and carrying.

It will be clear that the extendable utility bar of the invention can be manufactured for different size ranges and overall lengths. In accordance with one presently preferred embodiment, the bar has a minimum length of approximately 16 inches a maximum length of approximately 22 inches. Such a bar weighs only approximately 2.8 pounds—approximately 35% lighter than a regular 22 inch wrecking bar. Conveniently, when fully contracted the adjustable utility bar fits into an 18 inch tool box along with other hand tools.

Because of the use of hollow shanks or tubes less material is used and the tool can be produced at approximately 25% lower costs. Yet, the tool meets ANSI standards, passing 120% low test specifications.

Like conventional bars, the extendable utility bar can be used as a hammer, nail puller, short bar or long bar.

Also, because the adjustable or extendable utility bar can be opened or closed to a wide range of overall lengths, it is no longer necessary, as with conventional bars, to purchase and rely upon a plurality of different bars each of which may be usable for a given or specific application requiring a specified length. In the one extendable utility bar of the invention, therefore, can be used to replace combination sets of conventional utility bars that have traditionally been sold in a number of different sizes to provide the purchaser with that utility bar which best suits a given application. Now, one extendable utility bar fits almost all applications, so only a single utility bar need to be used, stored, transported and relied upon.

While the invention has been shown and described in connection with a preferred form of an embodiment it will be understood that modifications may be made without the departure from the scope or spirit of the invention.

What claimed is:

1. Extendable utility bar comprising a substantially straight elongate outer tube defining an axis and having inner and outer ends and an inner cylindrical surface;

a substantially straight elongate inner tube having an axis generally coextensive with said axis of said outer tube and having inner and outer ends and an outer cylindrical surface configured and dimensioned to be slidingly engaged at said inner ends within said outer tube in telescoping relationship to move between fully retracted and extended conditions in which said remote ends of said tubes are minimum and maximum distances, respectively, from each other; a first prying member at said remote end of said outer tube;

a second prying member at said remote end of said inner tube; and locking means for selectively locking said inner and outer tubes relative to each other to fix the positions of said prying members at a distance no less than said minimum distance and no greater than said maximum distance, whereby the length of the utility bar can be increased to provide increased prying leverage and can be decreased to shorten the length of the bar for storage or mobility.

2. Extendable utility bar as defined in claim 1, further comprising friction reducing means for reducing friction between said inner and outer tubes when said tubes are moved in telescoping relationship to each other.

3. Extendable utility bar as defined in claim 2, wherein said friction reducing means comprising a bushing between said tubes made of a low friction material.

4. Extendable utility bar as defined in claim 1, wherein said first prying member is selected from the group consisting of a hook and a chisel.

5. Extendable utility bar as defined in claim 1, wherein said second prying member is selected from the group consisting of a hook and a chisel.

6. Extendable utility bar as defined in claim 1, wherein stop means limits the relative movements of said tubes beyond said maximum distance to prevent separation of said tubes.

7. Extendable utility bar as defined in claim 1, wherein said inner end of said inner tube is provided with a member having at least an enlarged portion thereof in close proximity to said inner cylindrical surface; and further comprising blocking means at said inner end of said outer tube to provide an interference fit when said blocking means contacts said enlarged portion at said fully extended condition.

8. Extendable utility bar as defined in claim 7, wherein said blocking means comprises a bushing fixed to said inner end of said outer tube and having at least a portion thereof projecting radially inwardly towards said axis a distance sufficient to contact said enlarged portion in said fully extended condition.

9. Extendable utility bar as defined in claim 1, wherein said locking means an eccentric mechanism responsive to rotations of said tubes relative to each other about said axis.

10. Extendable utility bar as defined in claim 9, wherein said eccentric mechanism comprises an eccentric shaft portion attached to said inner end of said inner tube offset from said axis, and said eccentric ring concentric with said eccentric shaft portion and dimensioned to be pressed against said inner cylindrical surface in a locking condition of said eccentric mechanism to prevent axial movements of said tubes relative to each other, and to create a clearance with said eccentric shaft to relieve any frictional forces in to allow free axial movements of said tubes relative to each other in non-locking conditions of said tubes.

11. Extendable utility bar as defined in claim 10, wherein said eccentric ring has two diametrically opposite portions minimum and maximum radial dimensions.

12. Extendable utility bar as defined in claim 11, wherein said eccentric ring is provided with a circumferential gap in said portion of maximum radial dimension to allow said eccentric ring to radially expand when said eccentric shaft portion contacts said ring at said gap.

13. Extendable utility bar as defined in claim 11, wherein at least a portion of an outer perimeter of said eccentric ring is provided with alternating ridges and recesses.

14. Extendable utility bar as defined in claim 11, wherein said eccentric ring is made of a material that can create frictional forces when urged against said inner cylindrical surface.

15. Extendable utility bar as defined in claim 11, wherein said eccentric mechanism includes a coaxial post dimensioned to be received within said inner end of said inner tube, said eccentric shaft portion projecting axially outwardly towards said outer end of said outer tube.

16. Extendable utility bar as defined in claim 11, further comprising a generally transverse retaining disc normal to said axes and dimensioned to capture said eccentric ring and maintain it concentric with said eccentric shaft portion in all relative axial position of said tube.

17. Extendable utility bar as defined in claim 16, wherein said coaxial post is secured to said free end of said inner tube to insure a sharing of axial rotations of said inner tube and eccentric shaft portion.

18. Extendable utility bar as defined in claim 1, wherein said free end of said inner tube is provided with a threaded radial hole, and further comprising a set screw meshingly engaged within said threaded hole for providing a press fit with said post.

19. Extendable utility bar as defined in claim 18, wherein said post is provided with a depression or recess aligned to register with said set screw is advanced radially inwardly, whereby said eccentric shaft portion is assured to follow rotational movements of said inner tube about said axes.

20. An extendable utility bar comprising an elongate outer tubular member generally defining an axis;

an elongate inner tubular member telescopically coupled to said outer tubular member for sliding movements relative thereto along said axis between a retracted condition and an extended position, said tubular members having opposing free ends;

a first tip provided on a free end of one of said tubular members and a second tip provided on a free end of the other of said tubular members, said tips being configured to angularly extend from said axis;

stopping means cooperating with said tubular members to prevent extension of said tubular members beyond said extended position; and adjustment means for manually adjusting of said tubular members and selectively axially fixing said tubular members relative to each other in one of a plurality of intermediate conditions of said tubular members between said retracted and extended conditions, whereby the utility bar can have its axial length along said axis as measured between said first and second tips adjusted to accommodate desired work conditions.

* * * * *